United States Patent [19]

Twellmann

[11] Patent Number: 4,693,188

[45] Date of Patent: Sep. 15, 1987

[54] ROTATABLE SHELF INSERT FOR CORNER CUPBOARDS

[75] Inventor: Guenter Twellmann, Spenge-Lenzinghausen, Fed. Rep. of Germany

[73] Assignee: Ninkaplast GmbH, Bad Salzuflen, Fed. Rep. of Germany

[21] Appl. No.: 781,666

[22] Filed: Sep. 30, 1985

[30] Foreign Application Priority Data

Mar. 5, 1985 [DE] Fed. Rep. of Germany ..... 8506281

[51] Int. Cl.[4] ..... A47B 11/00

[52] U.S. Cl. ..... 108/139; 108/111

[58] Field of Search ..... 108/139, 142, 94, 95, 108/141, 111, 150, 156, 144, 106; 211/187, 189; 248/412, 230, 231.3

[56] References Cited

U.S. PATENT DOCUMENTS

| | | | |
|---|---|---|---|
| 2,031,754 | 2/1936 | Bacigalupi | 248/412 X |
| 2,637,613 | 5/1953 | Motter | 312/238 |
| 2,951,593 | 9/1960 | Lake | 211/144 |
| 3,169,496 | 2/1965 | Muggli et al. | 108/94 |
| 3,179,071 | 4/1965 | Johnston | 108/139 X |
| 3,604,369 | 9/1971 | Maslow | 108/144 |
| 3,612,290 | 10/1971 | Evans | 211/187 X |
| 3,628,844 | 12/1971 | Preston | 108/139 X |
| 3,675,598 | 7/1972 | Kesilman et al. | 108/106 X |
| 3,865,050 | 2/1975 | Cecchetti | 108/156 X |
| 3,869,218 | 3/1975 | Stoeber et al. | 211/189 X |
| 4,067,161 | 1/1978 | Rensch | 108/111 X |
| 4,114,763 | 9/1978 | Hochman | 211/57.1 |
| 4,128,064 | 12/1978 | Chung et al. | 108/111 |
| 4,158,336 | 6/1979 | Brescia et al. | 108/111 |
| 4,318,352 | 3/1982 | Friedman et al. | 108/111 |

FOREIGN PATENT DOCUMENTS

| | | | |
|---|---|---|---|
| 645248 | 7/1962 | Canada | 108/139 |
| 1273776 | 5/1972 | United Kingdom . | |

*Primary Examiner*—Kenneth J. Dorner
*Assistant Examiner*—José V. Chen
*Attorney, Agent, or Firm*—Schwartz, Jeffery, Schwaab, Mack, Blumenthal & Evans

[57] ABSTRACT

A rotatable shelf insert for corner cupboards comprising at least one shelf of substantially circular overall shape. A guide rod passes through a hub in the center of the shelf. The shelf is supported on the guide rod by means of a retaining pin passing through the guide rod at right angles. The hub receives the guide rod with radial play. A cylindrical clamping sleeve conically tapered at one end by variation of the wall thickness is inserted between the guide rod and the inner wall of the hub.

9 Claims, 1 Drawing Figure

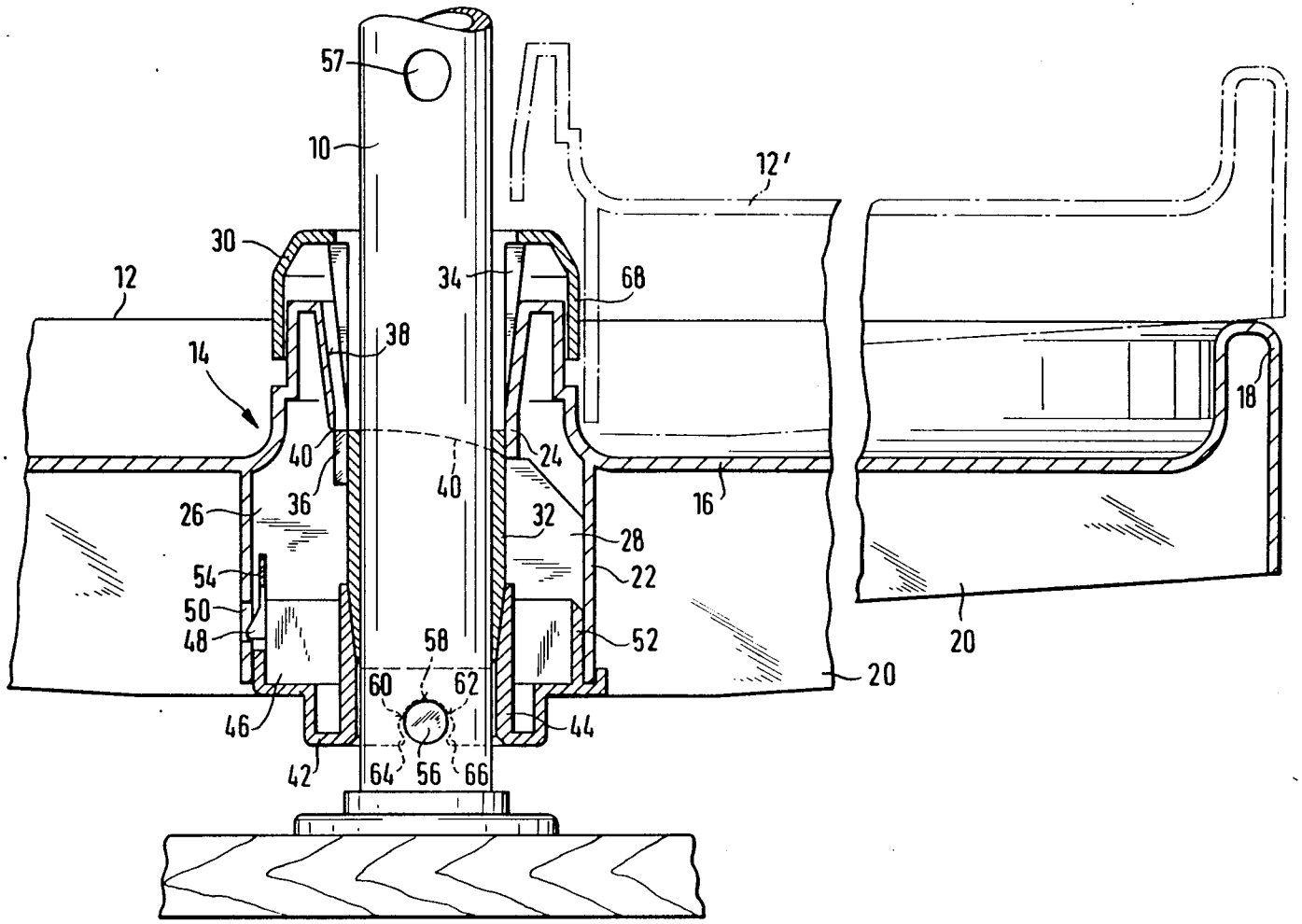
18
20
20
12'
16
68
28
22
52
44
24
32
34
40
62
66
58
56
57
38
60
64
10
40
36
42
30
14
26
54
50
48
46
12

ROTATABLE SHELF INSERT FOR CORNER CUPBOARDS

BACKGROUND OF THE INVENTION

The invention relates to a rotatable shelf insert for corner cupboards with at least one shelf of substantially circular overall shape, and a guide rod for supporting the shelf. The guide rod passes through a hub lying in the center of the circular shelf. A retaining pin passes through the guide rod at right angles and supports the shelf.

Inserts of this kind, which are also termed carousel inserts, serve principally to make use of the region of the internal corners of built-in kitchen cupboards. Since the space lying in the corners is only accessible with relative difficulty, and via a comparatively small opening, it has proved appropriate to employ rotatable shelves, so-called carousels. These carousels enable pots or other kitchen utensils to be put away, and moved when required, by rotating the shelf to the open side of the cupboard. The carousels generally have a cut-out (rectangular or otherwise) for receiving a door. A vertical guide rod is rotatably secured between the lower and upper wall surfaces of the cupboard. The guide rod carries at least one, but generally two shelves mounted to rotate substantially together.

To simplify assembly, easy insertion of the guide rod into the hub of the shelf necessary. With corresponding manufacturing tolerances, this can lead to considerable play between the shelf and the guide rod. Further play occurs between the retaining pin which runs perpendicularly through the guide rod and the corresponding holes in the guide rod. The shelves are thus able to tip relative to the guide rod, and are rotatable through a certain angle relatively to the guide rod, producing reduced stability.

SUMMARY OF THE INVENTION

An object underlying the present invention is to provide an insert of the generic type described, in which the shelves are held on the guide rod substantially free of play.

In accordance with the above object, there has been provided a rotatable shelf insert for corner cupboards, comprising a substantially circular shelf having a top and a bottom; a hub centrally disposed in the shelf and having a first inner wall; a guide rod for supporting the shelf, and passing through the hub, wherein a radial space is defined between the guide rod and the first inner wall; a cylindrical clamping sleeve having a lower end having a conically tapered wall, inserted in the radial space, and for clamping the shelf to the guide rod.

Preferably, the rotatable shelf insert according to the invention further comprises a supporting sleeve having a conically widening inner wall, and having a supporting surface for supporting the shelf, wherein the supporting sleeve is inserted into the radial space from the bottom of the shelf, wherein the clamping sleeve is inserted into the radial space from the top of the shelf, and wherein the conically tapered wall of the clamping sleeve engages the conically widening inner wall of the supporting sleeve.

Further objects, features and advantages of the present invention will become apparent from the detailed description of preferred embodiments, when considered together with the attached figure of drawing.

BRIEF DESCRIPTION OF THE DRAWING

The single FIGURE shows a vertical, partial section of a shelf according to the invention with a part of a guide rod.

DETAILED DESCRIPTION OF THE PREFERRED EMBODIMENTS

The above object is achieved according to the invention in that the hub receives the guide rod while defining a radial space, and a clamping sleeve is inserted in the radial space between the guide rod and the inner wall of the hub. The sleeve is cylindrical and tapered conically at one end by variation of the wall thickness.

The above solution offers the advantage that the guide rod can first be very simply pushed into the hub. The clamping rod is secured free of play on the hub only as a result of inserting the clamping sleeve. The clamping sleeve is clamped between the hub and the guide rod.

Preferably, the clamping sleeve is pushed into the hub from above. Expressions such as "above" and "below" relate in the present context in each case to the mounted position inside a corner cupboard. A supporting sleeve is inserted into the hub from below. The supporting sleeve has a conically enlarged internal diameter which cooperates with a conical tapering of the clamping sleeve. The supporting sleeve also serves to support the shelf on a retaining pin.

Two opposed openings are provided on the underside of the supporting sleeve for receiving the retaining pin. The openings have opposite side walls converging obliquely upwards, so that, when the shelf is placed in position, the retaining pin is clamped between the side walls, and a connection is made which is free of play. In addition, the opposite side walls can have lugs, behind which the retaining pin is locked.

Preferably, the clamping sleeve is able to be screwed into the hub from above. For this purpose, the clamping sleeve has at least one lug on its outer surface, which enters a thread turn in the inner wall surface of the hub.

The holes for receiving the retaining pin or pins in the guide rod are preferably not made round, but have side edges which converge obliquely downwards. The retaining pin can thus also assume a lower end position free of play in these holes.

In accordance with a particular advantageous embodiment, the clamping sleeve is enlarged conically outwards at its upper end, while the hub of the shelf has a corresponding conical enlargement or widening at its upper end. In this way, the clamping sleeve is clamped both at its upper end and also at its lower end. The clamping sleeve is clamped relative to the hub and relative to the supporting sleeve, so that it bears firmly against the guide rod and lies free of play within the hub. For easier radial deformation, the clamping sleeve can have suitably-positioned slits parallel to the axis.

Since the hub is closed from above and from below by the clamping sleeve and the supporting sleeve, respectively, the hub can be made shorter in the axial direction. Since the lower supporting sleeve can be omitted during transport, the shelves can, for transport purposes be pushed into one another in the hub region, so that a reduced stacking height results. A circumferential, upwardly projecting edge, may be provided so that the shelves can be stacked without tipping.

In the drawing, a guide rod is numbered 10 and a carousel or shelf is numbered 12. The guide rod 10 lies within a hub 14 of the shelf 12. The shelf comprises a supporting surface 16, which at the outer edge 18 is drawn up in an inverted U shape and is supported from the underside by ribs 20. The hub 14 can, in essence, be described as of double-layer construction with an outer sleeve 22 and an inner sleeve 24. The outer sleeve 22 and the inner sleeve 24 are joined together angularly at their upper ends. In addition, radial ribs 26, 28 are provided between the two sleeves, so that an overall stable hub construction results.

The inner sleeve 24 has at it upper end a conical enlargement or widening, not numbered, to which further reference will be made below. A clamping sleeve 30 is inserted into the hub 14 from above, and thus lies between the hub and the guide rod 10. The clamping sleeve 30 has a cylindrical tube portion 32, which is conically tapered at its lower end by a reduction of the wall thickness. At its upper end, the tube portion is conically enlarged by wedge-shaped ribs 34. At this upper end the tube portion is subdivided into individual segments by slits, not numbered, parallel to the axis, which facilitate radial deformation. The external cone formed by the ribs 34 corresponds to the internal cone at the upper end of the inner sleeve 24.

The cylindrical tube portion 32 of the clamping sleeve 30 has on the outside at least one lug 36, shown in the drawing on the left side. This lug can be inserted through a groove 38 in the region of the conical enlargement at the upper end of the inner sleeve 24 of the hub. The lower edge of the inner sleeve 24 is formed as a thread turn 40, over which the lug 36 slides relatively to the hub 14 when the clamping sleeve 30 is rotated. In this way the clamping sleeve 30 can be drawn into the hub by rotation. As a result, the conical outer surface of the clamping sleeve 30, formed by the ribs 34, clamps itself within the conical enlargement of the inner sleeve 24. The clamping sleeve 30 is thus pressed firmly against the guide rod 10, and the sleeve lies within the hub 14 without play.

At the same time, a corresponding clamping occurs at the lower end of the clamping sleeve with the help of the already-mentioned conical tapering of the tube portion 32 of the clamping sleeve. A supporting sleeve 42 is pushed from below into the outer sleeve 22 of the hub 14. The supporting sleeve has a cylindrical tube portion 44, which is conically enlarged at the upper end of its inner surface, by a reduction of the wall thickness.

This enlargement cooperates with the tapering at the lower end of the clamping sleeve 30, so that a corresponding radial clamping occurs at the lower end of the clamping sleeve 30 or of the hub 14.

In the region of the lower end of the tube portion 44 already-mentioned, the supporting sleeve 42 is flanged, at right angles outwards and then upwards. The supporting sleeve is then bent at right angles outwards and thereupon again guided parallel to the axis into the interior of the outer sleeve 22. Between the double-walled construction thus formed, there are radial ribs 46. These ribs 46 serve to support the ribs 26 of the hub 14 and thus the whole shelf 12 on the supporting sleeve 42.

The supporting sleeve 42 is locked relative to the hub 14 both in the rotary direction and also in the axial direction. The sleeve 42 does not rotate with or move with the clamping sleeve 30, and the entire shelf 12 is fixed on the guide rod 10 in the rotary direction, as will later be described in more detail.

At least one lug 48 is provided on the outside of the supporting sleeve 42 for locking the sleeve 42 in the axial direction. The lug 48 can latch in a window 50 of the outer sleeve 22 of the hub. The already-mentioned generally cylindrical, outer region 52 of the supporting sleeve 42 is preferably slit in a direction parallel to the axis to form individual tongues. The region 52 has an extended finger 54 which, in a predetermined angular position, enters into a corresponding recess, not numbered, in one of the ribs 26 between the inner sleeve 24 and the outer sleeve 22 of the hub 14, as is shown on the left side of the drawing. This configuration prevents further rotation of the sleeve 42.

The supporting sleeve 42 supports the shelf 12 on the guide rod 10. For this purpose, the guide rod 10 is transfixed by a retaining pin 56. At both its ends, the pin 56 extends for part of its length out of the guide rod 10. As is shown at the top of the drawing, the corresponding holes 57 in the guide rod are not circular in shape, but have edges converging obliquely downwards, so that the retaining pin 56, when under load, is pressed into a lower position free of play. The opposite, outwardly-extending ends of the retaining pin 56 lie in opposite openings 58 formed in the tube portion 44 of the supporting sleeve 42. These openings 58 have side walls 60, 62 converging obliquely upwards, so that the retaining pin 56, when under load, is also pressed into an upper end position free of play relative to the supporting sleeve 42. Small lugs 64, 66 at the lower edges of the opposite side walls 60, 62 serve for locking the retaining pin 56 in the pressed-in position, so that the supporting sleeve 42 and hence the entire shelf 12 are fixed relatively to the guide rod 10, even under upwardly-directed forces such as can arise during transport for example.

At its upper end, the clamping sleeve 30 has a circumferential edge 68 bent outwards and then downwards, which overlaps the hub 14 from outside and contributes to greater stability.

From the drawing it also appears that, before assembly, i.e., before insertion of the guide rod and the retaining pin, the shelf according to the invention can be stacked in a particularly convenient manner. To illustrate this, a further shelf numbered 12'0 is shown in broken lines. Since the upper clamping sleeve 30 and the lower supporting sleeve 42 are absent, the hubs of shelves lying one above one another fit within one another in the manner shown, saving space. Here, the stacking height in the region of the hub corresponds substantially with that height which appears in the region of the outer edge 18, so that the shelves can be stacked free of play. Relative to comparable shelves with a hub construction which cannot be taken apart, a space saving of about 40% results according to the invention.

What is claimed is:

1. A rotatable shelf insert for corner cupboards, comprising:

a substantially circular shelf having a top and a bottom;

a hub centrally disposed in and secured to the shelf and having a central aperture circumscribed by a first inner wall;

a guide rod for supporting the shelf, and passing through the hub, wherein a radial space is defined between the guide rod and the first inner wall;

means for rotatably mounting said guide rod;

means, including a cylindrical clamping sleeve inserted in the radial space and having a lower end conically tapered from wide to narrow to form a truncated conical shape at said lower end, for radially clamping, via radial force applied at said lower end, the hub and secured shelf to the guide rod for rotation with the guide rod; and a supporting sleeve comprising a cylindrical sleeve having an inner wall surrounding said guide rod, said cylindrical sleeve having an upper end at which said inner wall conically widens to form a tapered gap between said inner wall and said guide rod, and a supporting member connected to said cylindrical sleeve for supporting the shelf, wherein the cylindrical sleeve of the supporting sleeve extends into said radial space from the bottom of said shelf, wherein the clamping sleeve extends into the radial space from the top of said shelf, and wherein the conically tapered end of said clamping sleeve engages the conically widening inner wall of the supporting sleeve.

2. A rotatable shelf insert according to claim 1, further comprising a retaining pin having two ends extending from opposite sides of the guide rod, and means, disposed on said supporting sleeve, for engaging the retaining pin.

3. A rotatable shelf insert according to claim 2, further comprising hole means in said guide rod having side walls converging obliquely downwards, and for receiving the retaining pin.

4. A rotatable shelf insert according to claim 2, wherein said means for engaging comprise openings having side walls converging obliquely downwards.

5. A rotatable shelf insert according to claim 4, wherein said means for engaging further comprise first lug means for locking the retaining pin.

6. A rotatable shelf insert according to claim 1, further comprising a thread disposed on said inner wall of the hub and a second lug disposed on said clamping sleeve for engaging the thread.

7. A rotatable shelf insert according to claim 1, wherein the clamping sleeve includes an upper end comprising a conical widening, and wherein said inner wall of the hub is conically widened near said top of the shelf, for engaging the conical widening of the clamping sleeve.

8. A rotatable shelf insert according to claim 1, further comprising latching means for latching said supporting sleeve to said hub in a predetermined axial and angular position.

9. A rotatable shelf insert according to claim 1, wherein the hub includes an inner sleeve, an outer sleeve and radial ribs connecting the outer and inner sleeves; wherein the clamping sleeve includes a bent-over edge for overlapping the hub; and wherein the supporting sleeve engages the outer sleeve of the hub.

* * * * *